US005877664A

United States Patent [19]

Jackson, Jr.

[11] Patent Number: 5,877,664

[45] Date of Patent: Mar. 2, 1999

[54] MAGNETIC PROXIMITY SWITCH SYSTEM

[76] Inventor: John T. Jackson, Jr., 316 California Ave., Suite 745, Reno, Nev. 89509

[21] Appl. No.: 844,968

[22] Filed: Apr. 28, 1997

Related U.S. Application Data

[60] Provisional application No. 60/028,491 Oct. 15, 1996 and provisional application No. 60/030,988 Nov. 15, 1996 and provisional application No. 60/016,309 May 8, 1996.

[51] Int. Cl.[6] ..... H01H 9/00

[52] U.S. Cl. ..... 335/205; 335/207

[58] Field of Search ..... 335/205–7, 177–179

[56] References Cited

U.S. PATENT DOCUMENTS

| | | | |
|---|---|---|---|
| 2,912,540 | 11/1959 | Sawicki . | |
| 3,243,544 | 3/1966 | Mayer . | |
| 3,252,057 | 5/1966 | Hoeppel . | |
| 3,260,821 | 7/1966 | Yokoo . | |
| 3,305,805 | 2/1967 | Tann . | |
| 3,525,958 | 8/1970 | Rauterberg | 335/179 |
| 3,599,132 | 8/1971 | Schlessinger, Jr. . | |
| 3,626,340 | 12/1971 | Mason et al. . | |

(List continued on next page.)

FOREIGN PATENT DOCUMENTS

| | | |
|---|---|---|
| 0 451 974 A2 | 10/1991 | European Pat. Off. . |
| 2147034 A | 3/1973 | France . |
| 1926 786 U | 11/1965 | Germany . |
| 3526852 C2 | 3/1986 | Germany . |

OTHER PUBLICATIONS

Sentrol® Product Information Bulletin, "2700 Series High Security Balanced Magnetic Contacts" (4 pages), 1981.

Securiton Maximum Security Switch Data Sheet (2 pages), Apr. 1996.

*Primary Examiner*—Lincoln Donovan

[57] ABSTRACT

A proximity switch system includes a switch portion, configured to connect and disconnect at least one electrical path, and a magnetically active actuator. The switch portion has a casing formed of a magnetically noninteracting material, at least one electrical contact disposed in the casing, a magnetically active armature member moveable along the casing between a first position and a second position, wherein the armature member contacts the electrical contact when in the first position to connect the at least one electrical path and the armature member being electrically isolated from the electric contact when in the second position to disconnect the at least one electrical path, and a magnetically active biasing member disposed in the casing, wherein the biasing member magnetically interacts with the armature member to bias the armature member in one of the first and second positions. The magnetically active actuator is movable with respect to the switch portion between proximal and distal positions. The actuator magnetically interacts with the armature member when in the proximal position to move the armature to the other one of the first and second positions, and at least one of the armature member and the biasing member include a magnet.

75 Claims, 4 Drawing Sheets

U.S. PATENT DOCUMENTS

| | | | |
|---|---|---|---|
| 3,668,579 | 6/1972 | Harman . | |
| 3,717,830 | 2/1973 | Athey . | |
| 3,760,312 | 9/1973 | Schlesinger, Jr. . | |
| 3,806,852 | 4/1974 | Suska . | |
| 3,950,719 | 4/1976 | Maxwell . | |
| 3,974,469 | 8/1976 | Nicholls . | |
| 3,976,962 | 8/1976 | Seeley | 335/179 |
| 4,027,278 | 5/1977 | Giannini . | |
| 4,057,773 | 11/1977 | Cohen . | |
| 4,068,202 | 1/1978 | Lyons, III | 335/207 |
| 4,117,431 | 9/1978 | Eicher | 335/207 |
| 4,150,350 | 4/1979 | Fong . | |
| 4,210,888 | 7/1980 | Holce . | |
| 4,210,889 | 7/1980 | Holce . | |
| 4,210,899 | 7/1980 | Swonger et al. . | |
| 4,211,991 | 7/1980 | Lombard et al. . | |
| 4,213,110 | 7/1980 | Holce . | |
| 4,225,837 | 9/1980 | Fowler | 335/181 |
| 4,271,338 | 6/1981 | Rakocy . | |
| 4,339,747 | 7/1982 | Maybee . | |
| 4,349,800 | 9/1982 | Shimoya . | |
| 4,489,297 | 12/1984 | Haydon et al. . | |
| 4,544,903 | 10/1985 | Grant . | |
| 4,596,971 | 6/1986 | Hirabayashi et al. . | |
| 4,674,338 | 6/1987 | Carpenter | 73/861.77 |
| 4,752,756 | 6/1988 | Bartel | 335/205 |
| 4,837,539 | 6/1989 | Baker | 335/207 |
| 4,945,340 | 7/1990 | Brill . | |
| 5,057,807 | 10/1991 | Longly et al. . | |
| 5,128,641 | 7/1992 | Posey . | |
| 5,233,322 | 8/1993 | Posey . | |
| 5,233,323 | 8/1993 | Burkett et al. . | |
| 5,293,523 | 3/1994 | Posey . | |
| 5,416,456 | 5/1995 | Light . | |
| 5,668,533 | 9/1997 | Jackson, Jr. et al. . | |

MAGNETIC PROXIMITY SWITCH SYSTEM

The present application claims the benefit of Provisional U.S. patent application Ser. No. 60/016,309 (Jackson) filed May 8, 1996, which is hereby incorporated by reference. Provisional U.S. patent application Ser. No. 60/028,491 (Jackson) filed Oct. 15, 1996, and Provisional U.S. patent application Ser. No. 60/030,988 (Jackson) filed Nov. 15, 1996, are hereby incorporated by reference.

BACKGROUND OF THE INVENTION

1. Field of the Invention

The present invention relates to a switch, and more particularly to a magnetically operated proximity switch usable in, for example, a security system.

2. Discussion of the Related Art

While magnetic proximity switches are often confused with magnetic sensors, magnetic proximity switches represent a category of technology exclusive of magnetic sensors. Conventional magnetic proximity switches comprise some combination of magnetic material, electrical contacts, and a mechanism to effect switching. At least one of the electrical contacts is attached to a coiled spring or leaf spring. A reed switch is one example of a conventional magnetic proximity switch.

There are three basic types of reed switches: the dry reed, the mercury wetted reed, and the mercury wetted contact switching capsule. The magnetic behavior of all three reed switch types are similar, but the switches of the mercury type are restricted to certain mechanical orientations because they rely on gravity for successful operation. Mercury based switches also represent an environmental disposal hazard and are more expensive than the dry reed type.

FIG. 13 shows a perspective view of a conventional reed switch 100. The reed switch includes an electrically connecting lead wire 102 to which a flexible magnetically active electric contact member 104 is fixed, an electrically conducting lead wire 106 to which a nonmagnetically active rigid electrical contact member 108 is fixed, an optional lead wire 110 to which a magnetically active rigid electrical contact member 112 may be fixed. The system is enclosed in a hermetic glass envelope 114. In the absence of a magnetic field, the electrical contact 104 is in electrical contact with the non-magnetic electrical contact 108 as a result of a mechanical spring action created by the contact member 104. The lead and the electrical contacts 102, 104, 110, and 112 are composed of high permeability magnetic electrically conducting alloys such as Mu-Metal or the like for optimum performance. For proper operation of the switch, at least the electrical contact 108 must be non-magnetic so that no magnetic forces are developed therewith.

In the presence of a magnetic field, magnetic poles of opposite polarity are induced on the opposing sides of magnetically active electrical contact members 104 and 112. The resulting magnetic attraction overcomes the opposing mechanical spring force so that the electrical contact 104 bends to make electrical contact with electrical contact 112, as shown in FIG. 13. When the magnetic field is removed, the electrical contact returns to its original position electrical contact with electrical contact 108.

In selecting the materials, one desires materials with good electrical conductivity and magnetic properties which allow the activation of the switch. However, these two requirements conflict with each other. Magnetically active materials are not good conductors and good conductors are not magnetically active. Reed switch manufacturers generally optimize these requirements by electroplating the electrical contact area with Rhodium or Ruthenium. However, this combination is particularly sensitive to electrical arcing. As a result, a hermetically sealed glass envelope filled with an inert glass is required to prevent corrosion of the electrical contacts. Even in a hermetic environment, maintaining consistent electrical contact pressure is difficult.

The necessity of the hermetic seal of the glass envelope results in numerous disadvantages. For example, reed switches are highly susceptible to damage. Also, any manipulation or jarring of the lead wires will destroy the seal joint. Further, if the reed switch is dropped, the glass envelope will likely be broken. Moreover, a hermetically sealed environment prevents manufacturing of a magnetic proximity switch having adjustable sensitivity or electrical contact pressure.

Additionally, reed switches suffer from problems in that their size cannot be easily miniaturized. If one attempts to reduce the size of the switch, either the actuation gap range would diminish or the false alarm rate would increase. Furthermore, reed switches suffer from wear and deterioration of the spring mechanisms, and mechanical complexity.

Due to constraints imposed by the inherent structure of reed switches, incorporation of electrical contacts is compromised. Consequently, the life expectancy is extremely sensitive to operating conditions. Also, reed switches are sensitive to magnetic fields, thereby making them susceptible to extraneous fields generated by outside magnetic fields. This characteristic is further exasperated by the introduction of permanent biasing magnets used to polarize the reed switches for increased sensitivity. These problems cause unreliable performance, false alarms, or catastrophic failures, thereby resulting in increased costs and lack of trust in the corresponding security systems.

Because the read switch suffers from the above-noted limitations and disadvantages, an alternative design is needed.

SUMMARY OF THE INVENTION

Accordingly, the present invention is directed to a magnetic proximity switch system that substantially obviates one or more of the problems due to limitations and disadvantages of the related art.

An object of the invention is to eliminate the mechanical spring by suitable arrangement of magnetic materials such that the spring force is generated by magnetic fields.

Another object of the invention is to minimize arcing of the electrical contacts by use of magnetic fields.

Another object of the invention is to provide a switch achieving fast and reliable snap-action operation.

Another object of the invention is to provide a switch avoiding mechanical contact between, a switch actuator and a spring mechanism, and the electrical elements of the switch.

Another object of the invention is to provide a switch of sufficient simplicity that hermetic sealing of the electrical contacts is both practical and economical and, as a consequence of the hermetic seal, allowing greater flexibility in the choice of electrical contacts which also extends the life and reliability of the electrical contacts chosen.

Another object of the invention is to provide a switch that has adjustable sensitivity and adjustable contact pressure without mechanical contact with any of the electrical contact switching elements in an environment having a hermetic seal.

Another object of the invention is to provide a magnetic switch which is adapted for use in dusty, moist, explosive or combustible environments.

Another object of the invention is to provide a switch that, in at least one of its combinations, is substantially unidirectional to a magnetic field.

Another object of the invention is to provide a switch that can be actuated by any magnetic material or exclusively a permanent magnet.

Another object of the invention is to provide a switch with several possible combinations of magnetic materials and permanent magnets providing a variety of performance characteristics and ranges of economy.

Another object of the invention is to provide a switch that is bounceless.

Another object of the invention is to provide a switch that is a resettable latch.

Another object of the invention is to provide a switch that may be actuated through surfaces or at angles substantially away from perpendicular to the axis of the switch while maintaining unidirectionality without substantial loss of sensitivity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the magnetic proximity switch system includes a switch portion configured to connect and disconnect at least one electrical path, the switch portion having a first magnetically active member moveable between a first position for connecting the at least one electrical path and a second position for disconnecting the at least one electrical path, and a second magnetically active member magnetically interacting with the first magnetically active member to station the first magnetically active member to one of the first and second positions; and a magnetically active actuator movable relative to the switch portion between proximal and distal positions, wherein the actuator magnetically interacts with the first magnetically active member when in the proximal position for setting the first magnetically active member to the other one of the first and second positions, and wherein at least one of the first and second magnetically active members comprises a magnet.

In another aspect, the proximity switch system includes a switch portion, configured to connect and disconnect at least one electrical path, having a casing formed of a magnetically noninteracting material, at least one electrical contact disposed in the casing, a magnetically active armature member moveable along the casing between a first position and a second position, the armature member contacting the electrical contact when in the first position to connect the at least one electrical path and the armature member being electrically isolated from the electric contact when in the second position to disconnect the at least one electrical path, and a magnetically active biasing member disposed in the casing, wherein the biasing member magnetically interacts with the armature member to biasing the armature member in one of the first and second positions; and a magnetically active actuator movable with respect to the switch portion between proximal and distal positions, wherein the actuator magnetically interacts with the armature member when in the proximal position to move the armature to the other one of the first and second positions, and wherein at least one of the armature member and the biasing member include a magnet.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DESCRIPTION OF THE PREFERRED EMBODIMENTS

Figure 1:
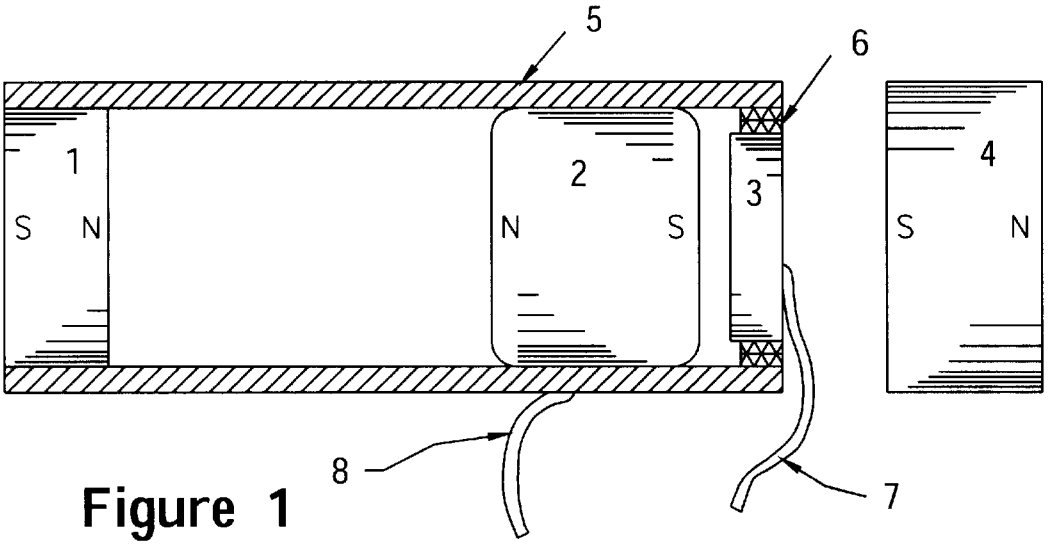
FIG. 1 is a schematic view of a single pole single throw magnetic switch in repulsion mode according to this an embodiment of the present invention.

Reference will now be made in detail to the preferred embodiments of the present invention, examples of which are illustrated in the accompanying drawings.

The magnetic proximity switch system according to the present invention comprises three main elements which are magnetically active and at least one of which is a magnet. The spring member is fixed in a predisposed position within the switch. The contact armature is limitedly movable within a switch casing. The contact armature may include electrical contacts or may itself be an electrical contact. The spring member biases the contact armature at one position via a magnetic interaction. The actuator, which is external to the switch, causes the contact armature to move to a second position when the actuator is proximate to the contact armature and overcomes the influence of the spring member. The movement of the contact armature from one position to the other causes electrical connections to be formed and unformed. Preferably, the contact armature may be constrained to travel along the axis of a tubular cavity within the switch casing having a cross-sectional of any shape. The contact member may move by sliding, be guided by linear bearings, or any other suitable means. One or both ends of travel may be constrained by electrical contacts fixed in predetermined locations to the spring magnet to make the switch single throw or double throw. The number of electrical poles is defined by the desired construction of the electrical contacts.

With the proximity switch system according to the present invention, the inherent presence of magnetic fields at the position of the electrical contacts tends to quench arcing. The magnetic proximity switch is inherently unidirectional, and, depending upon the particular combination of magnetic materials and permanent magnets, may be polarized. If the particular combination of magnetic materials are chosen and arranged such that the magnetic forces result in attraction, as opposed to repulsion, snap-action results. The sensitivity of any particular preferred embodiment of the switch, the maximum distance between the closest end of travel of the contact armature to the actuator and the actuator at which switching action commences, may be adjusted by changing the distance between the spring magnet and the end of travel of the contact armature closest to the spring magnet. Any preferred embodiment can be easily hermetically sealed to provide corrosion free electrical contacts and explosion proof switching. The motion of the contact armature from one end of travel to the other, which is constrained to travel along the axis of a tube of any cross-sectional shape, may be critically or over damped. The armature acts as a piston, by controlling the air flow within the tube to provide a bounceless switch. Pole pieces may be attached to the switch and to the actuator magnets which changes the angle of directionality away from the axis of the switch such that the switch may be oriented at angles to the actuator without substantial loss of sensitivity. This arrangement may be constructed such that the switch becomes a resettable latch. Two or more switches may be constructed in tandem whereby the actuation of one switch results in the actuation of the others.

The structure of the proximity switch system according to the present invention will now be described in detail with reference to FIGS. 1 through 12.

Referring to FIG. 1, a sectional view of a switch actuated by a permanent magnet actuator 4 in the open circuit state according to the present invention is shown which includes a switch casing or tube 5 made of any electrically conducting non-magnetic material, for example, copper. A spring magnet 1, made from any permanent magnet material, is fixed to the tube 5. An electrical contact 3, made of any suitable contact material that is non-magnetic, is attached to an electrical insulator 6, the electrical insulator being fixed to the tube 5. An electrically conducting wire 8 is electrically fastened to the tube 5. Another electrically conducting wire 7 is electrically fastened to the electrical contact 3. The contact armature 2, made from any conducting permanent magnet material, is in electrical contact with the tube 5.

When the actuator magnet 4 is sufficiently removed from the proximity of the contact armature 2, the contact armature 2 is repelled by the opposing forces between the spring magnet 1 and the contact armature 2 due to the predisposition of their like poles as shown and forced to make electrical contact with the electrical contact 3 resulting in a closed circuit. The actuator 4, when sufficiently proximate to the contact armature 2, over powers, by repulsion, the influence of the spring magnet 1 on the contact armature 2 causing it to travel away from the electrical contact 3, due to the predisposition of the like poles, resulting in an open circuit as shown. The predetermined distance between the spring magnet 1 and the contact armature 2 in combination with the magnetic properties of the spring magnet 1, the contact armature 2, and the actuator 4, sets the maximum actuation distance between the contact armature 2 and the actuator 4.

Figure 2:
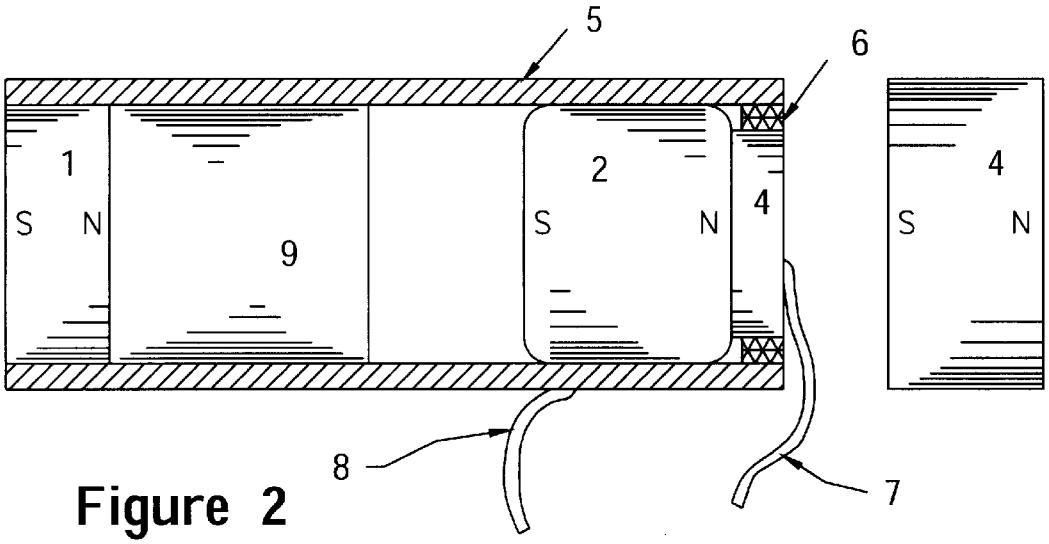
FIG. 2 is a schematic view of a single pole single throw magnetic switch with three permanent magnets in attraction mode according to another embodiment of the present invention.

Referring to FIG. 2, a sectional view of another switch actuated by a permanent magnet actuator 4 in the closed circuit state according to the present invention is shown which includes a switch casing or tube 5 made of any electrically conducting non-magnetic material for example copper. A spring magnet 1, made from any permanent magnet material, is fixed to the tube 5. An electrical contact 3, made of any suitable contact material that is non-magnetic, is attached to an electrical insulator 6, the electrical insulator being fixed to the tube 5. An electrically conducting wire 8 is electrically fastened to the tube 5. Another electrically conducting wire 7 is electrically fastened to the electrical contact 3. The contact armature 2, made from any conducting permanent magnet material, is in electrical contact with the tube 5. A spacer 9, made of any non-magnetic material, interposed between the spring magnet 1 and the contact armature 2, is fixed to the tube 5.

When the actuator magnet 4 is sufficiently removed from the proximity of the contact armature 2, the contact armature 2 is attracted to the spring magnet 1 by the forces between the spring magnet 1 and the contact armature 2 due to the predisposition of their opposite poles, as shown, and constrained by the spacer 9, which is fixed to the spring magnet 1, such that the contact armature 2 may not travel closer to the spring magnet 1 than the predetermined thickness of the spacer 9. The distance between the spring magnet 1 and the contact armature 2, as predetermined by the thickness of the spacer 9 in combination with the magnetic properties of the spring magnet 1, the contact armature 2, and the actuator 4, sets the maximum actuation distance between the contact armature 2 and the actuator 4. The actuator 4, when sufficiently proximate to the contact armature 2, over powers, by attraction, the influence of the spring magnet 1 on the contact armature 2 causing it to travel toward and make electrical contact with the electrical contact 3, by snap action, due to the predisposition of the opposite poles, resulting in a closed circuit as shown.

Figure 3:
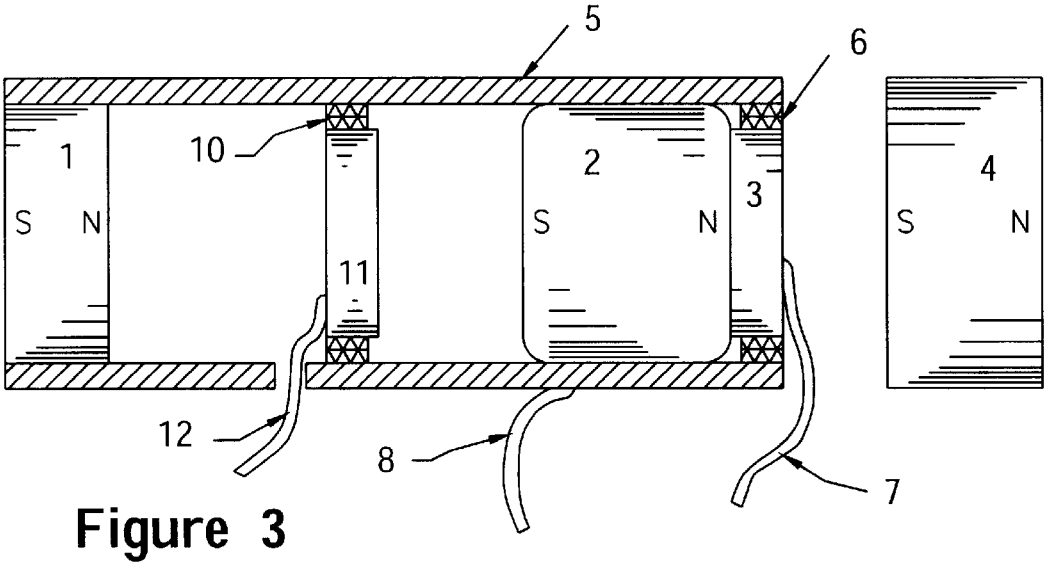
FIG. 3 is a schematic view of a single pole double throw magnetic switch with three permanent magnets in attraction mode according to another embodiment of the present invention.

Referring to FIG. 3, a sectional view of another switch actuated by a permanent magnet actuator 4 according to the present invention is shown which includes a switch casing or tube 5 made of any electrically conducting non-magnetic material for example copper. A spring magnet 1, made from any permanent magnet material, is fixed to the tube 5. An electrical contact 3, made of any suitable contact material that is non-magnetic, is attached to an electrical insulator 6, the electrical insulator being fixed to the tube 5. Another electrical contact 11, also made of any suitable contact material that is non-magnetic, is attached to an electrical insulator 10, the electrical insulator being fixed to the tube 5. An electrically conducting wire 8 is electrically fastened to the tube 5. Another electrically conducting wire 7 is electrically fastened to the electrical contact 3. Another electrically conducting wire 12 is electrically fastened to the electrical contact 11. The contact armature 2, made from any conducting permanent magnet material, is in electrical contact with the tube 5.

When the actuator magnet 4 is sufficiently removed from the proximity of the contact armature 2, the contact armature 2 is attracted to the spring magnet 1 by the forces between the spring magnet 1 and the contact armature 2 due to the predisposition of their opposite poles as shown and constrained by the electrical contact 11, such that the contact armature 2 may not travel closer to the spring magnet 1 than the predetermined distance between the spring magnet 1 and the position of electrical contact between the contact armature 2 and the electrical contact 11. This results in a closed circuit state between the electrical conductors 12 and 8 and an open circuit state between electrical conductors 8 and 7. The distance between the spring magnet 1 and the contact armature 2, as predetermined by the position of the electrical contact 11 in combination with the magnetic properties of the spring magnet 1, the contact armature 2, and the actuator 4, sets the maximum actuation distance between the contact armature 2 and the actuator 4. The actuator 4, when sufficiently proximate to the contact armature 2, over powers, by attraction, the influence of the spring magnet 1 on the contact armature 2 causing it to travel toward and make electrical contact with the electrical contact 3, by snap action, due to the predisposition of the opposite poles, resulting in an open circuit state between the electrical conductors 12 and 8 and a closed circuit state between electrical conductors 8 and 7 as shown.

Figure 4:
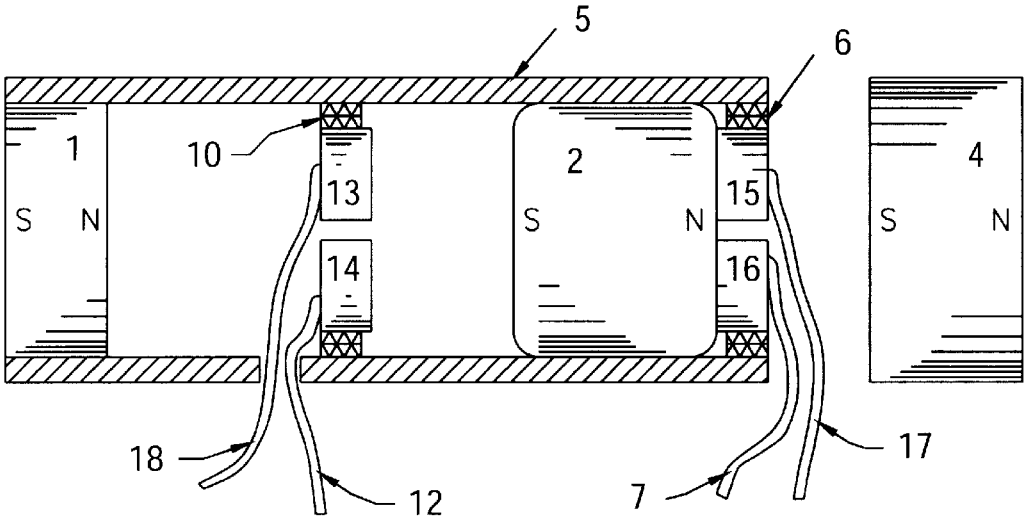
FIG. 4 is a schematic view of a double pole double throw magnetic switch with three permanent magnets in attraction mode according another embodiment of the present invention.

Referring to FIG. 4, a sectional view of another switch actuated by a permanent magnet actuator 4 according to the present invention is shown which includes a switch casing or tube 5 made of any non-magnetic material for example copper or glass. A spring magnet 1, made from any permanent magnet material, is fixed to the tube 5. A pair of electrical contacts 15 and 16, made of any suitable contact material that is non-magnetic, are attached to an electrical insulator 6, the electrical insulator being fixed to the tube 5. Another pair of electrical contacts 13 and 14, also made of any suitable contact material that is non-magnetic, is attached to an electrical insulator 10, the electrical insulator being fixed to the tube 5. An electrically conducting wire 7 is electrically fastened to the electrical contact 16. Another electrically conducting wire 17 is electrically fastened to the electrical contact 15. Another electrically conducting wire 12 is electrically fastened to the electrical contact 14. Another electrically conducting wire 18 is electrically fastened to the electrical contact 13. The contact armature 2 is made from any conducting permanent magnet material, although it need not be conducting if electrical contacts are attached and fixed to the contact armatures 2 pole faces.

When the actuator magnet 4 is sufficiently removed from the proximity of the contact armature 2, the contact armature 2 is attracted to the spring magnet 1 by the forces between the spring magnet 1 and the contact armature 2 due to the predisposition of their opposite poles as shown and constrained by the electrical contacts 13 and 14 such that the contact armature 2 may not travel closer to the spring magnet 1 than the predetermined distance between the spring magnet 1 and the position of electrical contacts between the contact armature 2 and the electrical contacts 13 and 14. This results in a closed circuit state between the electrical conductors 18 and 12 and an open circuit state between electrical conductors 7 and 17. The distance between the spring magnet 1 and the contact armature 2, as predetermined by the position of the electrical contacts 13 and 14 in combination with the magnetic properties of the spring magnet 1, the contact armature 2, and the actuator 4, sets the maximum actuation distance between the contact armature 2 and the actuator 4. The actuator 4, when sufficiently proximate to the contact armature 2, over powers, by attraction, the influence of the spring magnet 1 on the contact armature 2 causing it to travel toward and make electrical contact with the electrical contacts 15 and 16, by snap action, due to the predisposition of the opposite poles, resulting in an open circuit state between the electrical conductors 12 and 18 and a closed circuit state between electrical conductors 7 and 17 as shown.

Figure 5:
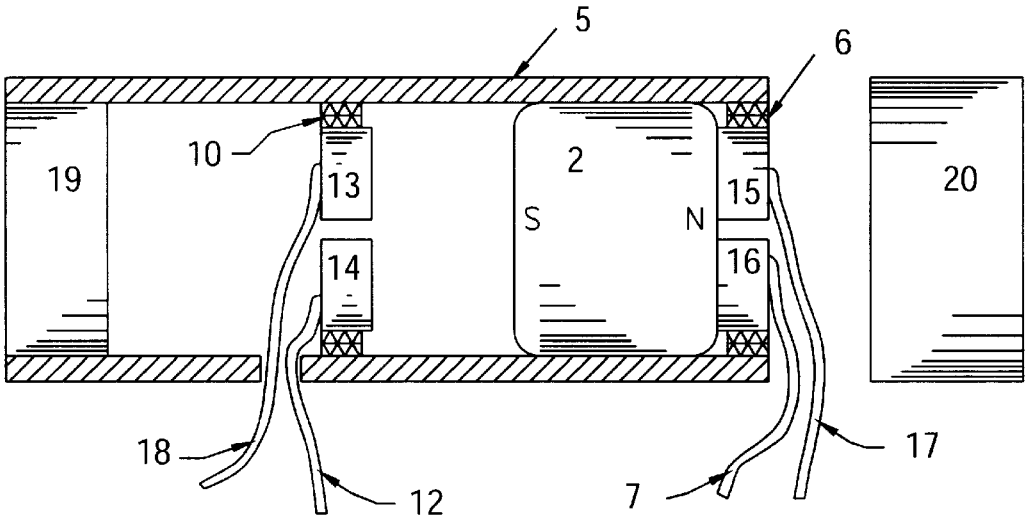
FIG. 5 is a schematic view of a double pole double throw magnetic switch with one permanent magnet in attraction mode according to another embodiment of the present invention.

Referring to FIG. 5, a sectional view of another switch showing an actuator 20 made from a ferromagnetic material that is not a permanent magnet, for example iron, according to the present invention which includes a switch casing or tube 5 made of any non-magnetic material for example copper or glass. A spring magnet 19, made from any ferromagnetic material that is not a permanent magnet, for example iron, is fixed to the tube 5. A pair of electrical contacts 15 and 16, made of any suitable contact material that is non-magnetic, are attached to an electrical insulator 6, the electrical insulator being fixed to the tube 5. Another pair of electrical contacts 13 and 14, also made of any suitable contact material that is non-magnetic, is attached to an electrical insulator 10, the electrical insulator being fixed to the tube 5. An electrically conducting wire 7 is electrically fastened to the electrical contact 16. Another electrically conducting wire 17 is electrically fastened to the electrical contact 15. Another electrically conducting wire 12 is electrically fastened to the electrical contact 14. Another electrically conducting wire 18 is electrically fastened to the electrical contact 13. The contact armature 2 is made from any conducting permanent magnet material although it need not be conducting if electrical contacts are attached and fixed to the contact armatures 2 pole faces.

When the actuator 20 is sufficiently removed from the proximity of the contact armature 2, the contact armature 2 is attracted to the spring magnet 19 and constrained by the electrical contacts 13 and 14 such that the contact armature 2 may not travel closer to the spring magnet 19 than the predetermined distance between the spring magnet 19 and the position of electrical contacts between the contact armature 2 and the electrical contacts 13 and 14. This results in a closed circuit state between the electrical conductors 18 and 12 and an open circuit state between electrical conductors 7 and 17. The distance between the spring magnet 19 and the contact armature 2, as predetermined by the position of the electrical contacts 13 and 14 in combination with the magnetic properties of the spring magnet 19, the contact armature 2, and the actuator 20, sets the maximum actuation distance between the contact armature 2 and the actuator 20. The contact armature 2, when the actuator 20 is sufficiently proximate to the contact armature 2, is more attracted to the actuator 20 than the spring magnet 19 causing the contact armature 2 to travel toward and make electrical contact with the electrical contacts 15 and 16, by snap action, resulting in an open circuit state between the electrical conductors 12 and 18 and a closed circuit state between electrical conductors 7 and 17 as shown.

Figure 6:
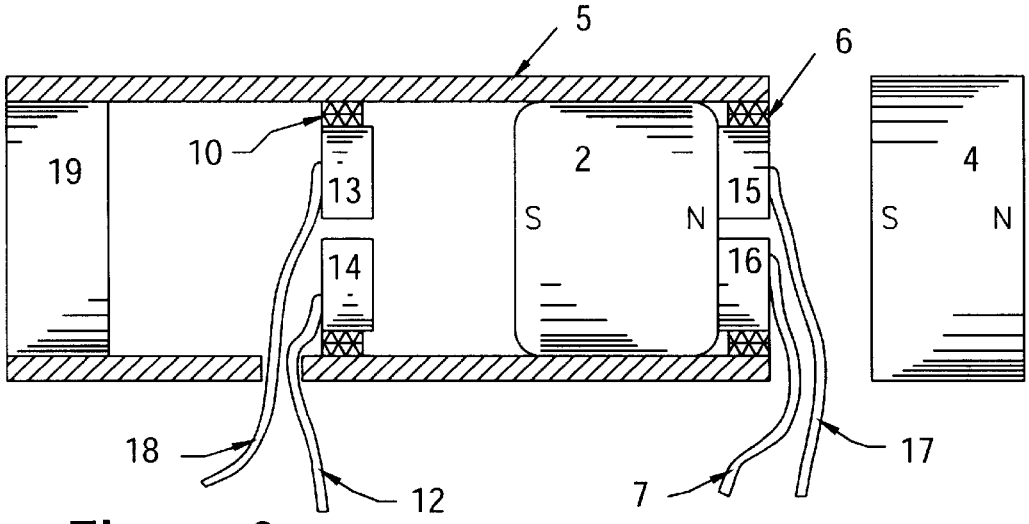
FIG. 6 is a schematic view of a double pole double throw magnetic switch with two permanent magnets in attraction mode according to another embodiment of the present invention.

Referring to FIG. 6, a sectional view of another switch actuated by a permanent magnet actuator 4 according to the present invention which includes a switch casing or tube 5 made of any non-magnetic material for example copper or glass. A spring magnet 19, made from any ferromagnetic material that is not a permanent magnet, for example iron, is fixed to the tube 5. A pair of electrical contacts 15 and 16, made of any suitable contact material that is non-magnetic, are attached to an electrical insulator 6, the electrical insulator being fixed to the tube 5. Another pair of electrical contacts 13 and 14, also made of any suitable contact material that is non-magnetic, is attached to an electrical insulator 10, the electrical insulator being fixed to the tube 5. An electrically conducting wire 7 is electrically fastened to the electrical contact 16. Another electrically conducting wire 17 is electrically fastened to the electrical contact 15. Another electrically conducting wire 12 is electrically fastened to the electrical contact 14. Another electrically conducting wire 18 is electrically fastened to the electrical contact 13. The contact armature 2 is made from any conducting permanent magnet material although it need not be conducting if electrical contacts are attached and fixed to the contact armatures 2 pole faces.

When the actuator magnet 4 is sufficiently removed from the proximity of the contact armature 2, the contact armature 2 is attracted to the spring magnet 19 and constrained by the electrical contacts 13 and 14 such that the contact armature 2 may not travel closer to the spring magnet 19 than the predetermined distance between the spring magnet 19 and the position of electrical contacts between the contact armature 2 and the electrical contacts 13 and 14. This results in a closed circuit state between the electrical conductors 18 and 12 and an open circuit state between electrical conductors 7 and 17. The distance between the spring magnet 19 and the contact armature 2, as predetermined by the position of the electrical contacts 13 and 14 in combination with the magnetic properties of the spring magnet 19, the contact armature 2, and the actuator magnet 4, sets the maximum actuation distance between the contact armature 2 and the actuator magnet 4. The contact armature 2, when the actuator magnet 4 is sufficiently proximate to the contact armature 2, is more attracted to the actuator magnet 4 than the spring magnet 19 causing the contact armature 2 to travel toward and make electrical contact with the electrical contacts 15 and 16, by snap action, resulting in an open circuit state between the electrical conductors 12 and 18 and a closed circuit state between electrical conductors 7 and 17 as shown.

Figure 7:
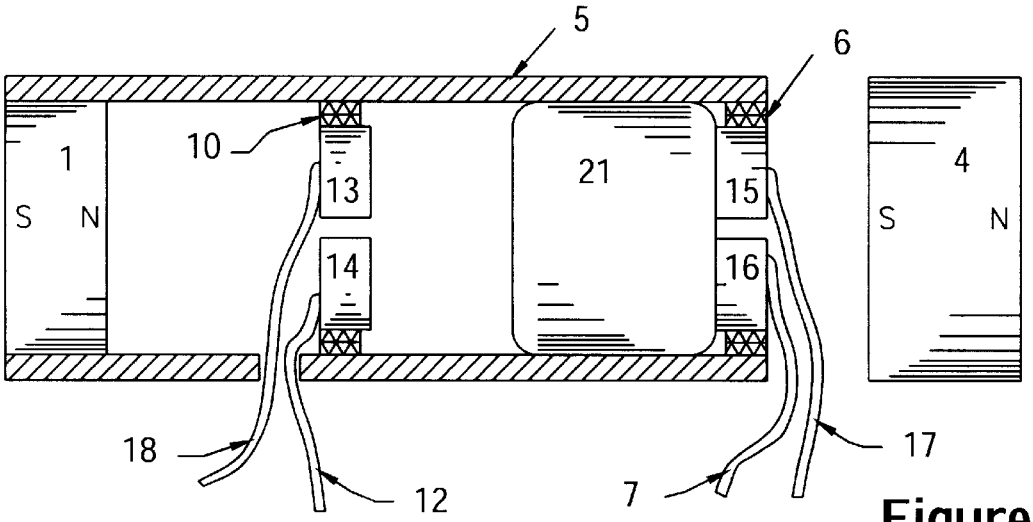
FIG. 7 is as schematic view of another double pole double throw magnetic switch with two permanent magnets in attraction mode according to another embodiment of the present invention.

Referring to FIG. 7, a sectional view of another switch actuated by a permanent magnet actuator 4 according to the present invention is shown which includes a switch casing or tube 5 made of any non-magnetic material for example copper or glass. A spring magnet 1, made from any permanent magnet material, is fixed to the tube 5. A pair of electrical contacts 15 and 16, made of any suitable contact material that is non-magnetic, are attached to an electrical insulator 6, the electrical insulator being fixed to the tube 5. Another pair of electrical contacts 13 and 14, also made of any suitable contact material that is non-magnetic, is attached to an electrical insulator 10, the electrical insulator being fixed to the tube 5. An electrically conducting wire 7 is electrically fastened to the electrical contact 16. Another electrically conducting wire 17 is electrically fastened to the electrical contact 15. Another electrically conducting wire 12 is electrically fastened to the electrical contact 14. Another electrically conducting wire 18 is electrically fastened to the electrical contact 13. The contact armature 21 is made from any conducting ferromagnetic material that is not a permanent magnet material although it need not be conducting if electrical contacts are attached and fixed to the contact armatures 21 contact faces.

When the actuator magnet 4 is sufficiently removed from the proximity of the contact armature 21, the contact armature 21 is attracted to the spring magnet 1 and constrained by the electrical contacts 13 and 14 such that the contact armature 21 may not travel closer to the spring magnet 1 than the predetermined distance between the spring magnet 1 and the position of electrical contacts between the contact armature 2 and the electrical contacts 13 and 14. This results in a closed circuit state between the electrical conductors 18 and 12 and an open circuit state between electrical conductors 7 and 17.

The distance between the spring magnet 1 and the contact armature 21, as predetermined by the position of the electrical contacts 13 and 14 in combination with the magnetic properties of the spring magnet 1, the contact armature 21, and the actuator 4, sets the maximum actuation distance between the contact armature 2 and the actuator 4. The actuator 4, when sufficiently proximate to the contact armature 21, over powers, by attraction, the influence of the spring magnet 1 on the contact armature 21 causing it to travel toward and make electrical contact with the electrical contacts 15 and 16, by snap action, due to the predisposition of the opposite poles, resulting in an open circuit state between the electrical conductors 12 and 18 and a closed circuit state between electrical conductors 7 and 17 as shown.

Figure 8:
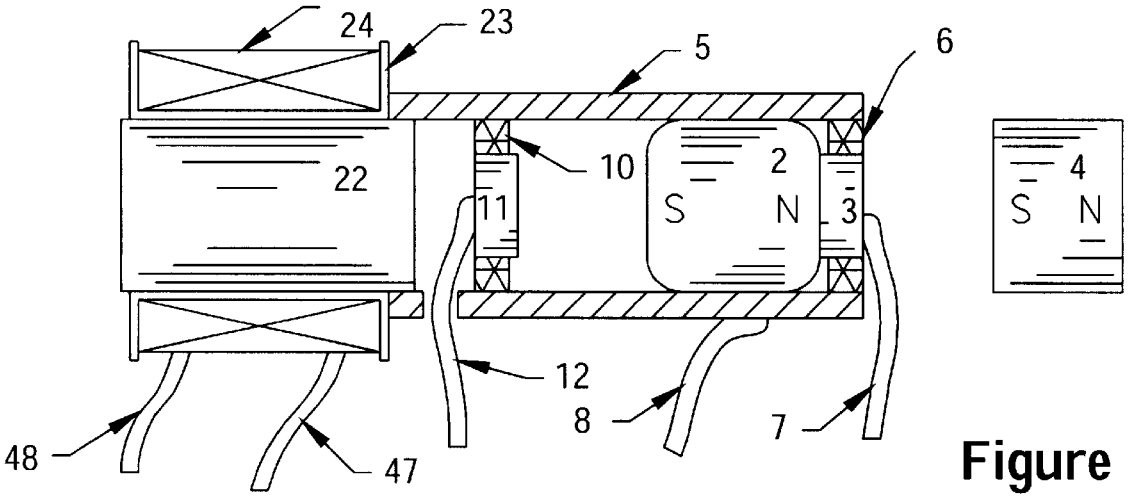
FIG. 8 is a schematic view of another single pole double throw magnetic switch with two permanent magnets in attraction mode and an electro-magnet according to another embodiment of the present invention.

Referring to FIG. 8, a sectional view of another switch actuated by a permanent magnet actuator 4 according to the present invention which includes a switch casing or tube 5 made of any non-magnetic material for example copper or glass. A spring magnet, an electro-magnet, consisting of a core 22, made from any ferromagnetic material that is not a permanent magnet, for example iron, and a solenoidal coil 24 wound on a coil bobbin 23, is fixed to the tube 5. Electrically conducting wires 47 and 48 are connected to the solenoidal coil 24 through which current of the appropriate polarity will make the core 22 functionally equivalent to a permanent magnet of variable strength. An electrical contact 3, made of any suitable contact material that is non-magnetic, is attached to an electrical insulator 6, the electrical insulator being fixed to the tube 5. Another electrical contact 11, also made of any suitable contact material that is non-magnetic, is attached to an electrical insulator 10, the electrical insulator being fixed to the tube 5. An electrically conducting wire 8 is electrically fastened to the tube 5. Another electrically conducting wire 7 is electrically fastened to the electrical contact 3. Another electrically conducting wire 12 is electrically fastened to the electrical contact 11. The contact armature 2, made from any conducting permanent magnet material, is in electrical contact with the tube 5.

When the actuator magnet 4 is sufficiently removed from the proximity of the contact armature 2, the contact armature 2 is attracted to the spring magnet core 22 whether the coil 24 is energized or not, and constrained by the electrical contacts 13 and 14 such that the contact armature 2 may not travel closer to the spring magnet core 22 than the predetermined distance between the spring magnet core 22 and the position of electrical contacts between the contact armature 2 and the electrical contacts 13 and 14. This results in a closed circuit state between the electrical conductors 8 and 12 and an open circuit state between electrical conductors 7 and 8. The distance between the spring magnet core 22 and the contact armature 2, as predetermined by the position of the electrical contacts 13 and 14 in combination with the magnetic properties of the spring magnet 19, the contact armature 2, the actuator magnet 4, and the magnitude of the current in the coil 24, sets the maximum actuation distance between the contact armature 2 and the actuator magnet 4. The contact armature 2, when the actuator magnet 4 is sufficiently proximate to the contact armature 2, is more attracted to the actuator magnet 4 than the spring magnet, electromagnet, causing the contact armature 2 to travel toward and make electrical contact with the electrical contacts 15 and 16, by snap action, resulting in an open circuit state between the electrical conductors 12 and 18 and a closed circuit state between electrical conductors 7 and 17 as shown.

Figure 9:
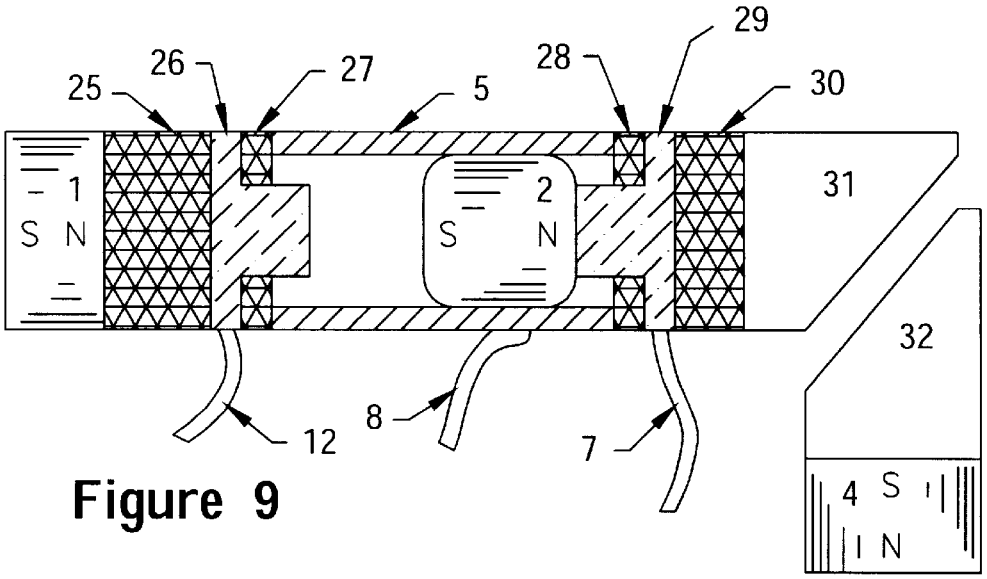
FIG. 9 is a schematic view of another single pole double throw magnetic switch with pole pieces according to another embodiment of the present invention.

Referring to FIG. 9, a sectional view of another switch with a actuator consisting of a permanent magnet 4 to which an actuator pole piece 32 is fixed according to the present invention is shown which includes a switch casing or tube 5 made of any electrically conducting non-magnetic material for example copper. A spring magnet 1, made from any permanent magnet material, is fixed to a spacer 25, made from any non-magnetic material for example copper of glass, and the spacer 25 is then fixed to the electrical contact 26. An electrical contact 26, made of any suitable contact material that is non-magnetic, is attached to an electrical insulator 27, the electrical insulator being fixed to the tube 5. Another electrical contact 29, also made of any suitable contact material that is non-magnetic, is attached to an electrical insulator 28, the electrical insulator being fixed to the tube 5. An electrically conducting wire 8 is electrically fastened to the tube 5. Another electrical conducting wire 7 is electrically fastened to the electrical contact 29. Another electrically conducting wire 12 is electrically fastened to the electrical contact 26. The contact armature 2, made from any conducting permanent magnet material, is in electrical contact with the tube 5. A pole piece 31, made of any ferromagnetic material that is not a permanent magnet, is fixed to another spacer 30, the spacer 30 being fixed to the electrical contact 29.

When the actuator is sufficiently removed from the proximity of the contact armature 2, the contact armature 2 is attracted to the spring magnet 1 by the forces between the spring magnet 1 and the contact armature 2 due to the predisposition of their opposite poles as shown and constrained by the electrical contact 26, such that the contact armature 2 may not travel closer to the spring magnet 1 than the predetermined distance between the spring magnet 1 and the position of electrical contact between the contact armature 2 and the electrical contact 26. This results in a closed circuit state between the electrical conductors 12 and 8 and an open circuit state between electrical conductors 8 and 7. The distance between the spring magnet 1 and the contact armature 2, as predetermined by the position of the electrical contact 26 and the length of the spacer 25 in combination with the magnetic properties of the spring magnet 1, the contact armature 2, the pole piece 31, and the actuator, sets the maximum actuation distance between the contact armature 2 and the actuator.

The spacer 30 must be of sufficient length such that the contact armature 2 is preferentially attracted toward the spring magnet 1 so as to make electrical contact with electrical contact 26 as opposed to the contact armature being attracted or actuated by the pole piece 31 when the actuator is not proximate. The actuator, when sufficiently proximate to the contact armature 2, over powers, by attraction, the influence of the spring magnet 1 on the contact armature 2 causing it to travel toward and make electrical contact with the electrical contact 29, by snap action, due to the predisposition of the opposite poles, resulting in an open circuit state between the electrical conductors 12 and 8 and a closed circuit state between electrical conductors 8 and 7 as shown. The function of the pole pieces 31 and 32 is to provide off switch axis actuation or actuation through surfaces not normal to the axis of the switch.

Figure 10:
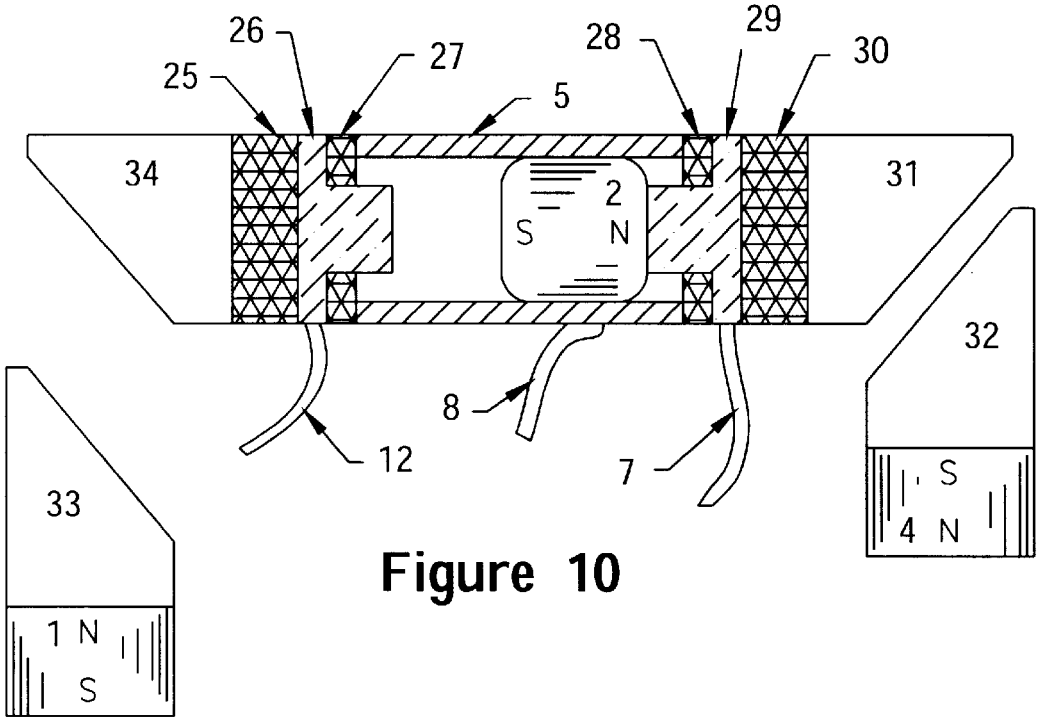
FIG. 10 is a schematic view of another single pole double throw magnetic switch operated as a resettable latch.

Referring to FIG. 10, a sectional view of another switch operated as a resetable latch with two actuators one consisting of a permanent magnet 4 to which an actuator pole piece 32 is fixed and the other actuator consisting of a permanent magnet 1 to which another actuator pole piece 33 is fixed according to the present invention is shown which includes a switch casing or tube 5 made of any electrically conducting non-magnetic material for example copper. A switch pole piece 34, made from any ferromagnetic material that is not a permanent magnet material, is fixed to a spacer 25, made from any non-magnetic material for example copper of glass, and the spacer 25 is then fixed to the electrical contact 26. Another switch pole piece 31, made from any ferromagnetic material that is not a permanent magnet material, is fixed to a spacer 30, made from any non-magnetic material for example copper of glass, and the spacer 30 is then fixed to the electrical contact 29. An electrical contact 29, made of any suitable contact material that is non-magnetic, is attached to an electrical insulator 28, the electrical insulator being fixed to the tube 5. Another electrical contact 26, also made of any suitable contact material that is nonmagnetic, is attached to an electrical insulator 27, the electrical insulator being fixed to the tube 5. An electrically conducting wire 8 is electrically fastened to the tube 5. Another electrically conducting wire 7 is electrically fastened to the electrical contact 29. Another electrically conducting wire 12 is electrically fastened to the electrical contact 26. The contact armature 2, made from any conducting permanent magnet material, is in electrical contact with the tube 5.

Both switch pole pieces, 31 and 34, may be of equal length and must be of sufficient length such that the contact armature 2 is attracted to which ever switch pole piece it was last closest to. In this manner, if both actuators are sufficiently removed from proximity of the contact armature 2, the contact armature will not be in a metastable state and therefore in stable electrical contact with which ever electrical contact it was last caused to make electrical contact with by its respective actuator. If the actuator consisting of actuator magnet 1 and its pole piece 33 is sufficiently removed from proximity to its respective switch pole piece 34 such that there is no actuation influence, and the other actuator consisting of the actuator magnet 4 and its pole piece 32 is sufficiently proximate to actuate the contact armature 2, then the contact armature 2 will be attracted away from the influence of the switch pole piece 34, by snap action, unless the contact armature 2 was already in that position. This results in a closed circuit state between the electrical conductors 7 and 8 and an open circuit state between electrical conductors 8 and 12.

Now, if the actuator is removed from proximity to the switch and the other actuator is moved into proximity to the switch, then the contact armature 2 will be attracted away from the influence of the switch pole piece 31, by snap action. This results in a closed circuit state between the electrical conductors 12 and 8 and an open circuit state between electrical conductors 8 and 7 and the switch has been reset. The distance between the switch pole pieces, 31 and 34, and the contact armature 2, as predetermined by the position of the electrical contacts, 26 and 29, and the length of the spacers, 25 and 30, in combination with the magnetic properties of the actuator magnets, 1 and 4, and their respective pole pieces, and the contact armature 2, sets the maximum actuation distance between the contact armature 2 and the actuators. The switch is therefore a resetable latch that remembers its last actuation state and does not change state until it has been reset even if both actuators are subsequently removed from actuation proximity.

Figure 11:
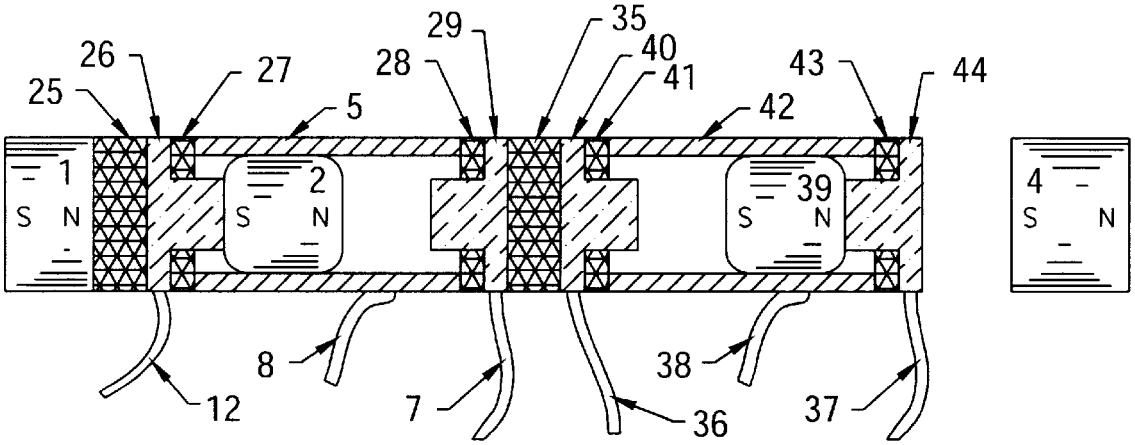
FIG. 11 is a schematic view of two single pole double throw magnetic switches operated in tandem.

Referring to FIG. 11, a sectional view of two switches connected in tandem, such that both are actuated by one permanent magnet actuator 4, according to the present invention are shown which includes a switch casings or tubes, 5 and 42, made of any electrically conducting non-magnetic material for example copper. The first switch consists of a spring magnet 1, made from any permanent magnet material, is fixed to a spacer 25, made from any non-magnetic material for example copper of glass, and the spacer 25 is then fixed to the electrical contact 26. An electrical contact 26, made of any suitable contact material that is non-magnetic, is attached to an electrical insulator 26, the electrical insulator being fixed to the tube 5.

Another electrical contact 29, also made of any suitable contact material that is non-magnetic, is attached to an electrical insulator 28, the electrical insulator being fixed to the tube 5. An electrically conducting wire 8 is electrically fastened to the tube 5. Another electrically conducting wire 7 is electrically fastened to the electrical contact 29. Another electrically conducting wire 12 is electrically fastened to the electrical contact 26. The contact armature 2, made from any conducting permanent magnet material, is in electrical contact with the tube 5. A pole piece 31, made of any ferromagnetic material that is not a permanent magnet, is fixed to another spacer 30, the spacer 30 being fixed to the electrical contact 29.

The second switch consists of a spacer 35, made from any non-magnetic material for example copper or glass, and the spacer 35 is then fixed to the electrical contact 40. The electrical contact 40, made of any suitable contact material that is non-magnetic, is attached to an electrical insulator 41, the electrical insulator being fixed to the tube 42. Another electrical contact 44, also made of any suitable contact material that is non-magnetic, is attached to an electrical insulator 43, the electrical insulator being fixed to the tube 42. An electrically conducting wire 38 is electrically fastened to the tube 42. Another electrically conducting wire 37 is electrically fastened to the electrical contact 44. Another electrically conducting wire 36 is electrically fastened to the electrical contact 40. The contact armature 39, made from any conducting permanent magnet material, is in electrical contact with the tube 42.

When the actuator magnet 4 is sufficiently removed from the proximity of the contact armature 39, the contact armature 39 is attracted to the contact armature 2, by snap action, due to the predisposition of their opposite poles as shown and constrained by the electrical contacts, 29 and 40, such that the contact armature 2 may not travel closer to the contact armature 39 than the predetermined distance between the contact surfaces of electrical contacts 28 and 40. This results in a closed circuit state between the electrical conductors 7 and 8 and an open circuit state between electrical conductors 8 and 12. Additionally, there exists a closed circuit state between the electrical conductors 36 and 38 and an open circuit state between electrical conductors 38 and 37. The actuator, when sufficiently proximate to the contact armature 39, over powers, by attraction, the influence of the contact magnet 2 on the contact armature 39 causing contact armature 39 to travel toward and make electrical contact with the electrical contact 44, by snap action, and additionally, contact magnet 2 is now preferentially attracted toward and makes electrical contact with electrical contact 26, by snap action, resulting in an open circuit state between the electrical conductors 7 and 8 and a closed circuit state between electrical conductors 8 and 12 and, also, an open circuit state between the electrical conductors 36 and 38 and a closed circuit state between electrical conductors 38 and 37 as shown.

Figures 12A, 12B:
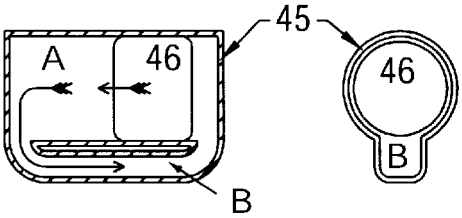
FIGS. 12A and 12B are schematic views showing a means for adjusting air flow around the armature.
Figure 13:
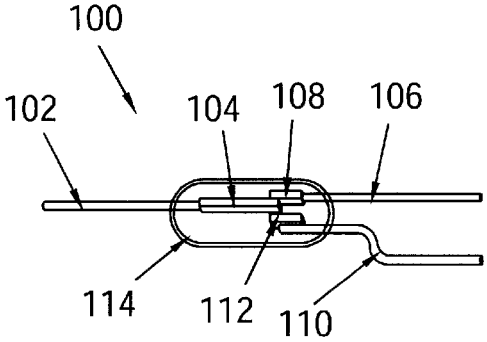
Figure 13 Prior Art
FIG. 13 is schematic view of a reed switch according to a conventional proximity switch.

FIG. 12B shows one possible switch housing or tube 45 cross-sectional view according to the present invention wherein the contact armature 46 acts as a piston with its gas relief passage B. FIG. 12A shows a sectional view of the tube 45 and contact armature 46 such that the gas flow from chamber A is relieved through the relief passage B to the other side of the contact armature 46 and equalizing the gas pressure. The arrows show the contact armature 46 and gas flow direction. If the gas relief passage is suitably sized, the contact armature bounce at the end of travel can be critically or over damped resulting in a bounceless switch.

In accordance with a number of preferred embodiments of this invention, a magnetically actuated switch is described wherein switching action is accomplished by the proximity of a movable actuator with contact armature, to which at least one electrical contact is attached or itself is an electrical contact. These two members are magnetically attracted or repelled by one another, such that the force of attraction or repulsion between the contact armature and a spring member, which is also magnetically active, is overcome causing the second member to move from a first predetermined location to a second predetermined location. The armature, is interposed between the actuator and the spring member. There may be at least one electrical contact at either or both of the predetermined locations, one contact being disposed between the actuator and the armature, and the other contact being disposed between the armature and the spring member, such that the switch contacts are either opened or closed.

The three members may be magnetically hard, a permanent magnet, or magnetically soft, herein referred to as "ferrous material", and at least one of the members is a magnet. In Table 1 and Table 2, all possible combinations of magnets and ferrous material are shown where one (1) indicates a permanent magnet and zero (0) indicates ferrous material. The magnetic poles of all adjacent member faces are predisposed such that they are either opposite poles resulting in a attracting force, or they are "like" poles resulting in a repelling force.

TABLE 1

| | ATTRACTING POLES | | |
|---|---|---|---|
| Combinations | Spring | Armature | Actuator |
| 1 | 1 | 1 | 1 |
| 2 | 1 | 1 | 0 |
| 3 | 1 | 0 | 1 |
| 4 | 0 | 1 | 1 |
| 5 | 0 | 1 | 0 |
| 6 | 1 | 0 | 0 |
| 7 | 0 | 0 | 1 |
| 8 | 0 | 0 | 0 |

In the attracting mode, Table 1, a single magnet must be in the armature position, or any combination of at least two magnets must be used for the switch to be functional. Combinations 1 through 5 are functional. Combinations 6 and 7 are non-functional unless gravity or some other force is used. Combination 8 is non-functional.

TABLE 2

| REPELLING POLES | | | |
|---|---|---|---|
| Combinations | Spring | Armature | Actuator |
| 1 | 1 | 1 | 1 |
| 2 | 0 | 1 | 1 |
| 3 | 1 | 1 | 0 |
| 4 | 1 | 0 | 1 |
| 5 | 0 | 1 | 0 |
| 6 | 1 | 0 | 0 |
| 7 | 0 | 0 | 1 |
| 8 | 0 | 0 | 0 |

In the repelling mode, Table 2, combinations 4 through 8 are functionally equivalent to the attracting mode and add nothing new. In combinations 2 and 3, the presence of ferrous material, represented by zero (0), yields no opposing force on the contact armature and are therefore non-functional, at least without gravity. Combination 1 is functional but does not result in snap-action when actuated in the repelling mode.

Further, an electromagnet may be wound solenoidally and concentrically about the axis of the contact armature assembly to bias switching or act as an actuator. Additionally, electro-magnets may be substituted for either the spring magnet or the actuator. Using an electro-magnet as the spring magnet provides the proximity switch with continuously variable sensitivity and contact pressure by electronic means.

It will be apparent to those skilled in the art that various modifications and variations can be made in the magnetic proximity switch system of the present invention without departing from the spirit or scope of the invention. Thus, it is intended that the present invention cover the modifications and variations of this invention provided they come within the scope of the appended claims and their equivalents.

What is claimed is:

1. A proximity switch system, comprising:

a switch portion configured to connect and disconnect at least one electrical path, the switch portion including:

an electrical contact forming part of the at least one electrical path;

a first magnetically active member moveable between a first position for contacting the electrical contact to connect the at least one electrical path and a second position for disconnecting the at least one electrical path, and a second magnetically active member magnetically interacting with the first magnetically active member to station the first magnetically active member to one of the first and second positions; and a magnetically active actuator movable relative to the switch portion between proximal and distal positions, wherein the actuator magnetically interacts with the first magnetically active member when in the proximal position for setting the first magnetically active member to the other one of the first and second positions, wherein at least one of the first and second magnetically active members comprises a magnet and wherein when the magnetically active actuator is in the proximal position, the electrical contact is disposed between the first magnetically active member and at least one of the second magnetically active member and the magnetically active actuator.

2. The proximity switch system according to claim 1, wherein the first magnetically active member includes a permanent magnet.

3. The proximity switch system according to claim 1, wherein the second magnetically active member lacks a permanent magnet.

4. The proximity switch system according to claim 1, further comprising a casing defining a tubular cavity, the first magnetically active member being disposed in the tubular cavity.

5. The proximity switch system according to claim 1, further comprising an electrically conductive casing defining a tubular cavity, wherein the first magnetically active member is disposed in the tubular cavity, and wherein the first magnetically active member forms an electrical path between the electrical contact and the casing when the first magnetically active member is located in the first position.

6. The proximity switch system according to claim 1, further comprising a casing defining a tubular cavity and a second electrical contact, wherein the first magnetically active member is disposed in the tubular cavity, and wherein the first magnetically active member forms an electrical path between the electrical contact and the second electrical contact when the first magnetically active member is located in the first position.

7. The proximity switch system according to claim 1, further comprising a contact plate disposed on a surface of the first magnetically active member facing toward the first position, wherein the electrical contact is one of a pair of separated electrical contacts disposed at the first position, the contact plate forming an electrical path between the pair of separated electrical contacts when the first magnetically active member is located in the first position.

8. The proximity switch system according to claim 7, further comprising a second pair of separated electrical contacts disposed at the second position and a second contact plate disposed on a surface of the first magnetically active member facing toward the second position, wherein the contact plate forms an electrical path between the second pair of separated electrical contacts when the first magnetically active member is located in the second position.

9. The proximity switch system according to claim 1, further comprising a spacer disposed between the first and second magnetically active members.

10. The proximity switch system according to claim 1, wherein the magnet is an electro-magnet.

11. The proximity switch system according to claim 1, wherein the second magnetically active member is moveable such that the switch operates as a resettable latch.

12. The proximity switch system according to claim 1, further comprising a third magnetically active member, the third magnetically active member movable between third and fourth positions such that the switch operates as a tandem switch.

13. The proximity switch system according to claim 1, further comprising a casing defining a tubular cavity and a gas relief passage, wherein the first magnetically active member is disposed in the tubular cavity, and wherein the gas flow passage allows gas pressure to be equalized as the first magnetically active member moves between the first and second positions.

14. A proximity switch system, comprising:

a switch portion configured to connect and disconnect at least one electrical path, the switch portion including:

a casing formed of a magnetically noninteracting material, at least one electrical contact disposed in the casing, a magnetically active armature member moveable along the casing between a first position and a second position, the armature member contacting the electrical contact when in the first position to connect the at least one electrical path and the armature member being electrically isolated from the electrical contact when in the second position to disconnect the at least one electrical path, and a magnetically active biasing member disposed in the casing, the biasing member magnetically interacting with the armature member to bias the armature member in one of the first and second positions; and a magnetically active actuator movable with respect to the switch portion between proximal and distal positions, the actuator magnetically interacting with the armature member when in the proximal position to move the armature member to the other one of the first and second positions, wherein at least one of the armature member and the biasing member comprise a magnet and wherein the electrical contact is disposed between the armature member and at least one of the biasing member and the actuator.

15. The proximity switch system according to claim 14, wherein the armature member includes a permanent magnet.

16. The proximity switch system according to claim 14, wherein the biasing member lacks a permanent magnet.

17. The proximity switch system according to claim 14, wherein the casing defines a tubular cavity, the armature member disposed in the tubular cavity.

18. The proximity switch system according to claim 14, wherein casing includes an electrically conductive material and defines a tubular cavity, wherein the armature member is disposed in the tubular cavity, and wherein the armature member forms the electrical path between the at least one electrical contact and the casing when the armature member is located in the first position.

19. The proximity switch system according to claim 14, wherein the casing defines a tubular cavity and includes a second electrical contact, wherein the armature member is disposed in the tubular cavity, and wherein the armature member forms the electrical path between the at least one electrical contact and the second electrical contact when the armature member is located in the first position.

20. The proximity switch system according to claim 14, wherein the at least one electrical contact includes a pair of separated electrical contacts disposed at the first position, wherein a contact plate is disposed on a surface of the armature member facing toward the first position, and wherein the contact plate forms the electrical path between the pair of separated electrical contacts when the armature member is located in the first position.

21. The proximity switch system according to claim 14, wherein the at least one electrical contact includes first and second pairs of separated electrical contacts disposed at the first and second positions, wherein first and second contact plates are respectively disposed on surfaces of the armature member facing toward the first position and toward the second position, wherein the first contact plate forms the electrical path between the first pair of separated electrical contacts when the armature member is located in the first position, and wherein the second contact plate forms the electrical path between the second pair of separated electrical contacts when the armature member is located in the second position.

22. The proximity switch system according to claim 14, further comprising a spacer disposed between the armature member and the biasing member.

23. The proximity switch system according to claim 14, wherein the magnet is an electro-magnet.

24. The proximity switch system according to claim 14, wherein the biasing member is moveable such that the switch portion operates as a resettable latch.

25. The proximity switch system according to claim 14, further comprising a second armature member, the second armature member movable between third and fourth positions such that the switch portion operates as a tandem switch.

26. The proximity switch system according to claim 14, wherein the casing defines a tubular cavity and a gas relief passage, wherein the armature member is disposed in the tubular cavity, and wherein the gas flow passage allows gas pressure to be equalized as the armature member moves between the first and second positions.

27. The proximity switch system according to claim 14, wherein when the actuator is in the proximal position, the armature member, the biasing member and actuator are each disposed along an axis of the proximity switch system with the armature member disposed between the biasing member and the actuator.

28. The proximity switch system according to claim 1, wherein when the magnetically active actuator is in the proximal position, the first magnetically active member, the second magnetically active member, and the magnetically active actuator are each disposed along an axis of the proximity switch system with the first magnetically active member disposed between the second magnetically active member and the magnetically active armature.

29. A proximity switch system, comprising:

a switch portion configured to connect and disconnect at least one electrical path, the switch portion including:

first and second electrical contacts forming part of the at least one electrical path;

a first magnetically active member moveable between a first position for contacting the first and second electrical contacts to connect the at least one electrical path and a second position for disconnecting the at least one electrical path, the first magnetically active member not contacting either the first electrical contact or the second electrical contact when in the second position, and a second magnetically active member magnetically interacting with the first magnetically active member to station the first magnetically active member to one of the first and second positions; and a magnetically active actuator movable relative to the switch portion between proximal and distal positions, wherein the actuator magnetically interacts with the first magnetically active member when in the proximal position for setting the first magnetically active member to the other one of the first and second positions, wherein at least one of the first and second magnetically active members comprises a magnet.

30. The proximity switch system according to claim 29, wherein the first magnetically active member includes a permanent magnet.

31. The proximity switch system according to claim 29, further comprising a casing defining a tubular cavity, the first magnetically active member being disposed in the tubular cavity.

32. The proximity switch system according to claim 29, further comprising a contact plate disposed on a surface of the first magnetically active member facing toward the first position, wherein the contact plate forms an electrical path between the first and second electrical contacts when the first magnetically active member is located in the first position.

33. The proximity switch system according to claim 32, further comprising third and fourth electrical contacts disposed at the second position and a second contact plate disposed on a surface of the first magnetically active member facing toward the second position, wherein the contact plate forms an electrical path between the third and the fourth electrical contacts when the first magnetically active member is located in the second position.

34. The proximity switch system according to claim 29, further comprising a first pole piece formed of a magnetically active material attached to the switch portion and a second pole piece formed of a magnetically active material attached to the magnetically active actuator, the first and second pole pieces providing actuation when the actuator is off an axis defined by the movement of the first magnetically active member.

35. The proximity switch system according to claim 29, further comprising a third magnetically active member, the third magnetically active member movable between third and fourth positions such that the switch operates as a tandem switch.

36. The proximity switch system according to claim 29, further comprising a casing defining a tubular cavity and a gas relief passage, wherein the first magnetically active member is disposed in the tubular cavity, and wherein the gas flow passage allows gas pressure to be equalized as the first magnetically active member moves between the first and second positions.

37. A proximity switch system, comprising:

a switch portion configured to connect and disconnect at least one electrical path, the switch portion including:

a first magnetically active member moveable between a first position for connecting the at least one electrical path and a second position for disconnecting the at least one electrical path, the first magnetically active member having a contact surface that forms a part of the at least one electrical path when the first magnetically active member is in the first position, and a second magnetically active member magnetically interacting with the first magnetically active member to station the first magnetically active member to one of the first and second positions; and a magnetically active actuator movable relative to the switch portion between proximal and distal positions, wherein the actuator magnetically interacts with the first magnetically active member when in the proximal position for setting the first magnetically active member to the other one of the first and second positions, wherein at least one of the first and second magnetically active members comprises a magnet.

38. The proximity switch system according to claim 37, further comprising a casing defining a tubular cavity, the first magnetically active member being disposed in the tubular cavity.

39. The proximity switch system according to claim 37, further comprising an electrically conductive casing defining a tubular cavity and an electrical contact disposed at the first position, wherein the first magnetically active member is disposed in the tubular cavity, and wherein the first magnetically active member forms an electrical path between the electrical contact and the casing when the first magnetically active member is located in the first position.

40. The proximity switch system according to claim 37, further comprising a casing defining a tubular cavity and first and second electrical contacts, wherein the first magnetically active member is disposed in the tubular cavity, the first electrical contact is disposed at the first position, and the first magnetically active member forming an electrical path between the first electrical contact and the second electrical contact when the first magnetically active member is located in the first position.

41. The proximity switch system according to claim 37, further comprising a first pole piece formed of a magnetically active material attached to the switch and a second pole piece formed of a magnetically active material attached to the actuator, the first and second pole pieces providing actuation when the actuator is off an axis defined by the movement of the first magnetically active member.

42. The proximity switch system according to claim 37, further comprising a third magnetically active member, the third magnetically active member movable between third and fourth positions such that the switch operates as a tandem switch.

43. The proximity switch system according to claim 37, further comprising a casing defining a tubular cavity and a gas relief passage, wherein the first magnetically active member is disposed in the tubular cavity, and wherein the gas flow passage allows gas pressure to be equalized as the first magnetically active member moves between the first and second positions.

44. A proximity switch system, comprising:

a switch portion configured to connect and disconnect at least one electrical path, the switch portion including:

a first magnetically active member moveable between a first position for connecting the at least one electrical path and a second position for disconnecting the at least one electrical path, a contact portion attached to a surface of the first magnetically active member, the contact portion forming a part of the at least one electrical path when the first magnetically active member is in the first position, and a second magnetically active member magnetically interacting with the first magnetically active member to station the first magnetically active member to one of the first and second positions; and a magnetically active actuator movable relative to the switch portion between proximal and distal positions, wherein the actuator magnetically interacts with the first magnetically active member when in the proximal position for setting the first magnetically active member to the other one of the first and second positions, wherein at least one of the first and second magnetically active members comprises a magnet.

45. The proximity switch system according to claim 44, further comprising a casing defining a tubular cavity, the first magnetically active member being disposed in the tubular cavity.

46. The proximity switch system according to claim 44, further comprising an electrically conductive casing defining a tubular cavity and an electrical contact disposed at the first position, wherein the first magnetically active member is disposed in the tubular cavity, and wherein the first magnetically active member forms an electrical path between the electrical contact and the casing when the first magnetically active member is located in the first position.

47. The proximity switch system according to claim 44, wherein the contact portion includes a contact plate.

48. The proximity switch system according to claim 44, further comprising a pair of separated electrical contacts disposed at the first position, wherein the contact portion forms an electrical path between the pair of separated electrical contacts when the first magnetically active member is located in the first position.

49. The proximity switch system according to claim 48, further comprising a second pair of separated electrical contacts disposed at the second position and a second contact portion disposed on a surface of the first magnetically active member, wherein the contact plate forms an electrical path between the second pair of separated electrical contacts when the first magnetically active member is located in the second position.

50. The proximity switch system according to claim 44, further comprising a first pole piece formed of a magnetically active material attached to the switch and a second pole piece formed of a magnetically active material attached to the actuator, the first and second pole pieces providing actuation when the actuator is off an axis defined by the movement of the first magnetically active member.

51. The proximity switch system according to claim 44, further comprising a third magnetically active member, the third magnetically active member movable between third and fourth positions such that the switch operates as a tandem switch.

52. A proximity switch system, comprising:

a switch portion configured to connect and disconnect at least one electrical path, the switch portion including:

an electrically conductive casing forming part of the at least one electrical path;

an electrical contact forming part of the at least one electrical path;

a first magnetically active member moveable between a first position for electrically connecting the electrical contact with the casing to connect the at least one electrical path and a second position for disconnecting the at least one electrical path, and a second magnetically active member magnetically interacting with the first magnetically active member to station the first magnetically active member to one of the first and second positions; and a magnetically active actuator movable relative to the switch portion between proximal and distal positions, wherein the actuator magnetically interacts with the first magnetically active member when in the proximal position for setting the first magnetically active member to the other one of the first and second positions, wherein at least one of the first and second magnetically active members comprises a magnet.

53. The proximity switch system according to claim 52, wherein the first magnetically active member includes a contact portion on a surface thereof.

54. A proximity switch system, comprising:

a switch portion configured to connect and disconnect at least one electrical path, the switch portion including:

an electrically conductive casing formed of a magnetically noninteracting material, at least one electrical contact disposed in the casing, a magnetically active armature member moveable along the casing between a first position and a second position, the armature member connecting the at least one electrical path between the electrical contact and the casing when the armature member is in the first position and the armature member being electrically isolated from the electrical contact when in the second position to disconnect the at least one electrical path, and a magnetically active biasing member disposed in the casing, the biasing member magnetically interacting with the armature member to bias the armature member in one of the first and second positions;

and a magnetically active actuator movable with respect to the switch portion between proximal and distal positions, the actuator magnetically interacting with the armature member when in the proximal position to move the armature member to the other one of the first and second positions, wherein at least one of the armature member and the biasing member comprise a magnet.

55. The proximity switch system according to claim 54, wherein the armature member includes a contact portion on a surface thereof.

56. A proximity switch system, comprising:

a switch portion configured to connect and disconnect at least one electrical path, the switch portion including:

a casing formed of a magnetically noninteracting material, first and second electrical contacts disposed in the casing, a magnetically active armature member moveable along the casing between a first position and a second position, the armature member contacting both the first and second electrical contacts when in the first position to connect the at least one electrical path and the armature member being electrically isolated from both the first and the second electrical contact when in the second position to disconnect the at least one electrical path, and a magnetically active biasing member disposed in the casing, the biasing member magnetically interacting with the armature member to bias the armature member in one of the first and second positions;

and a magnetically active actuator movable with respect to the switch portion between proximal and distal positions, the actuator magnetically interacting with the armature member when in the proximal position to move the armature member to the other one of the first and second positions, wherein at least one of the armature member and the biasing member comprise a magnet.

57. The proximity switch system according to claim 56, wherein the armature member includes a permanent magnet.

58. The proximity switch system according to claim 56, wherein the armature member includes a contact plate on the surface thereof, the contact plate forming the electrical path between the first and second electrical contacts when the armature member is located in the first position.

59. The proximity switch system according to claim 58, further comprising third and fourth electrical contacts disposed in the casing, wherein a second contact plate is disposed on a surface of the armature member to form an electrical path between the third and fourth electrical contacts when the armature member is located in the second position.

60. The proximity switch system according to claim 56, further comprising a first pole piece formed of a magnetically active material attached to the switch portion and a second pole piece formed of a magnetically active material attached to the actuator, the first and second pole pieces providing actuation when the actuator is off an axis defined by the movement of the armature member.

61. The proximity switch system according to claim 56, further comprising a second armature member, the second armature member movable between third and fourth positions such that the switch portion operates as a tandem switch.

62. The proximity switch system according to claim 56, wherein the casing defines a tubular cavity and a gas relief passage, wherein the armature member is disposed in the tubular cavity, and wherein the gas flow passage allows gas pressure to be equalized as the armature member moves between the first and second positions.

63. A proximity switch system, comprising:

a switch portion configured to connect and disconnect at least one electrical path, the switch portion including:

a casing formed of a magnetically noninteracting material, at least one electrical contact disposed in the casing, a magnetically active armature member moveable along the casing between a first position and a second position, the armature member having a contact surface that contacts the electrical contact and forms a part of the at least one electrical path when the armature member is in the first position, the armature member being electrically isolated from the electrical contact when in the second position to disconnect the at least one electrical path, and a magnetically active biasing member disposed in the casing, the biasing member magnetically interacting with the armature member to bias the armature member in one of the first and second positions;

and a magnetically active actuator movable with respect to the switch portion between proximal and distal positions, the actuator magnetically interacting with the armature member when in the proximal position to move the armature member to the other one of the first and second positions, wherein at least one of the armature member and the biasing member comprise a magnet.

64. The proximity switch system according to claim 63, wherein the casing includes an electrically conductive material and defines a tubular cavity, wherein the armature member is disposed in the tubular cavity, and wherein the armature member forms the electrical path between the at least one electrical contact and the casing when the armature member is located in the first position.

65. The proximity switch system according to claim 63, wherein the at least one electrical contact includes a pair of separated electrical contacts, and wherein the contact surface forms the electrical path between the pair of separated electrical contacts when the armature member is located in the first position.

66. The proximity switch system according to claim 63, further comprising a first pole piece formed of a magnetically active material attached to the switch portion and a second pole piece formed of a magnetically active material attached to the actuator, the first and second pole pieces providing actuation when the actuator is off an axis defined by the movement of the armature member.

67. The proximity switch system according to claim 63, further comprising a second armature member, the second armature member movable between third and fourth positions such that the switch portion operates as a tandem switch.

68. The proximity switch system according to claim 63, wherein the casing defines a tubular cavity and a gas relief passage, wherein the armature member is disposed in the tubular cavity, and wherein the gas flow passage allows gas pressure to be equalized as the armature member moves between the first and second positions.

69. A proximity switch system, comprising:

a switch portion configured to connect and disconnect at least one electrical path, the switch portion including:

a casing formed of a magnetically noninteracting material, at least one electrical contact disposed in the casing, a magnetically active armature member moveable along the casing between a first position and a second position, a contact portion attached to a surface of the armature member, the contact portion contacting the electrical contact and forming a part of the at least one electrical path when the armature member is in the first position and the at least one electrical path being disconnected when the armature member is in the second position, and a magnetically active biasing member disposed in the casing, the biasing member magnetically interacting with the armature member to bias the armature member in one of the first and second positions;

and a magnetically active actuator movable with respect to the switch portion between proximal and distal positions, the actuator magnetically interacting with the armature member when in the proximal position to move the armature member to the other one of the first and second positions, wherein at least one of the armature member and the biasing member comprise a magnet.

70. The proximity switch system according to claim 69, wherein the at least one electrical contact includes a pair of separated electrical contacts disposed at the first position, wherein the contact portion is disposed on a surface of the armature member facing toward the first position, and wherein the contact portion forms the electrical path between the pair of separated electrical contacts when the armature member is located in the first position.

71. The proximity switch system according to claim 69, wherein the at least one electrical contact includes first and second pairs of separated electrical contacts disposed at the first and second positions, wherein the contact portion includes first and second contact portions respectively disposed on surfaces of the armature member facing toward the first position and toward the second position, wherein the first contact portion forms the electrical path between the first pair of separated electrical contacts when the armature member is located in the first position, and wherein the second contact portion forms the electrical path between the second pair of separated electrical contacts when the armature member is located in the second position.

72. The proximity switch system according to claim 69, further comprising a first pole piece formed of a magnetically active material attached to the switch portion and a second pole piece formed of a magnetically active material attached to the actuator, the first and second pole pieces providing actuation when the actuator is off an axis defined by the movement of the armature member.

73. The proximity switch system according to claim 69, wherein the casing defines a tubular cavity and a gas relief passage, wherein the armature member is disposed in the tubular cavity, and wherein the gas flow passage allows gas pressure to be equalized as the armature member moves between the first and second positions.

74. The proximity switch system according to claim 69, wherein the contact portion includes a contact plate.

75. A magnetic proximity switch configured to connect and disconnect at least one electrical path, comprising:

first and second electrical contacts forming part of the at least one electrical path;

a magnetically active armature member moveable according to an external magnetic field between a first position and a second position, the armature member contacting both the first and second electrical contacts when in the first position to connect the at least one electrical path and the armature member being electrically isolated from both the first and the second electrical contact when in the second position to disconnect the at least one electrical path; and a magnetically active biasing member magnetically interacting with the armature member to bias the armature member in one of the first and second positions in the absence of the external magnetic field.

* * * * *